US010317074B1

(12) United States Patent
Hamilton et al.

(10) Patent No.: US 10,317,074 B1
(45) Date of Patent: Jun. 11, 2019

(54) HAND-HELD MEDICATION AND ELECTRONIC WASTE INCINERATOR

(71) Applicant: Mini Incinerator, LLC, Lexington, SC (US)

(72) Inventors: Brett P. Hamilton, Lexington, SC (US); Lisa A. Hamilton, Lexington, SC (US); James W. Kronberg, Aiken, SC (US)

(73) Assignee: Mini Incinerator, LLC, Lexington, SC (US)

( * ) Notice: Subject to any disclaimer, the term of this patent is extended or adjusted under 35 U.S.C. 154(b) by 108 days.

(21) Appl. No.: 15/800,894

(22) Filed: Nov. 1, 2017

Related U.S. Application Data

(60) Provisional application No. 62/472,249, filed on Mar. 16, 2017.

(51) Int. Cl.

| | |
|---|---|
| ***F23G 5/24*** | (2006.01) |
| ***F23G 5/08*** | (2006.01) |
| ***F23J 15/02*** | (2006.01) |
| ***F23G 5/40*** | (2006.01) |
| ***F23G 7/00*** | (2006.01) |
| ***F23G 5/50*** | (2006.01) |

(52) U.S. Cl.
CPC ..... *F23G 5/08* (2013.01); *F23G 5/24* (2013.01); *F23G 5/40* (2013.01); *F23G 5/50* (2013.01); *F23G 7/003* (2013.01); *F23J 15/025* (2013.01); *F23G 2202/60* (2013.01); *F23G 2209/20* (2013.01); *F23G 2900/50804* (2013.01)

(58) Field of Classification Search
CPC ..... F23G 5/24; F23G 5/40; F23G 5/50; F23G 7/003; F23J 15/025
See application file for complete search history.

(56) References Cited

U.S. PATENT DOCUMENTS

| | | | | |
|---|---|---|---|---|
| 2,469,414 A | | 5/1949 | Schechter | |
| 2,914,061 A | * | 11/1959 | Del Raso ..... | A47J 36/30 126/262 |
| 4,072,786 A | | 2/1978 | Hinsche et al. | |
| 4,687,467 A | | 8/1987 | Cygielski | |
| 4,747,503 A | | 5/1988 | Dingess | |
| 4,816,021 A | | 3/1989 | Johnson | |

(Continued)

*Primary Examiner* — Nathaniel Herzfeld
(74) *Attorney, Agent, or Firm* — Nexsen Pruet, LLC; Michael A. Mann

(57) ABSTRACT

A hand-held, disposable incinerator for medications and electronic storage media includes a body and a lid, a layer of insulation, and a chemical burn agent, which on ignition produces both heat and oxygen to destroy the contents. Exhaust gases pass through a non-combustible filter to remove most solid particles and contaminants, followed by a second, higher-efficiency filter. Hot gases exiting from the incinerator then desirably ignite again from their own heat, consuming remaining volatile organic matter distilled from the items being destroyed. An igniter, which may be a fuse, a pull-tab-activated pyrotechnic delay or an electronically remote-triggered igniter, provides a delay for the safety of the person using the incinerator. Heat generated within the burn chamber decomposes most organic materials, melts soft metals including aluminum and electronic solder, and renders data storage devices unreadable. At least an inner portion of the device may be safely discarded.

20 Claims, 15 Drawing Sheets

(56) References Cited

U.S. PATENT DOCUMENTS

| | | | | | |
|---|---|---|---|---|---|
| 4,819,612 | A * | 4/1989 | Okamoto | F24V 30/00 | 126/263.01 |
| 5,020,509 | A * | 6/1991 | Suzuki | A47J 36/30 | 126/263.01 |
| 5,230,715 | A * | 7/1993 | Iizuna | A47J 36/30 | 148/307 |
| 5,299,556 | A * | 4/1994 | Ando | A47J 36/30 | 126/263.01 |
| 5,551,355 | A * | 9/1996 | Haines | A61M 5/3278 | 110/242 |
| 6,007,736 | A | 12/1999 | Zhang et al. | | |
| 6,080,461 | A | 6/2000 | Wozniak et al. | | |
| 6,264,896 | B1 | 7/2001 | Zhang et al. | | |
| 6,365,185 | B1 | 4/2002 | Ritschel et al. | | |
| 6,945,180 | B1 * | 9/2005 | Khymych | F23G 5/10 | 110/203 |
| 7,896,271 | B2 | 3/2011 | Wakeman | | |
| 8,224,455 | B2 | 7/2012 | Mon et al. | | |
| 8,347,702 | B2 | 2/2013 | Mon et al. | | |
| 8,388,907 | B2 | 3/2013 | Gold et al. | | |
| 9,360,398 | B2 | 6/2016 | Gold et al. | | |
| 2003/0226483 | A1 * | 12/2003 | Oiwa | F23G 5/165 | 110/235 |

* cited by examiner

HAND-HELD MEDICATION AND ELECTRONIC WASTE INCINERATOR

TECHNOLOGICAL FIELD

The technological field relates to incinerators, and to incineration of items such as unwanted medications and electronic devices in particular.

BACKGROUND

For a variety of reasons, a quantity of medications otherwise intended for personal use may no longer be needed and should therefore be properly disposed of. Often, these left-over medications are just thrown away or flushed down a toilet. Not all medications break down quickly into harmless elements or compounds, and may environmentally persist long enough in soil or water to present a hazard to plants, animals or humans. Safe disposal occurs when the compounds in the medication are reduced to simpler chemical forms so that they present no biological hazard.

Similarly, the growing use of electronic devices which are physically small but capable of massive data storage, such as thumb drives, data cards, smart phones and hard disk drives, poses a problem for information security. If such a device falls into the wrong hands, it could disclose personal data allowing identity theft or other harm to its former owner. "Safe disposal" in this case would occur if a discarded device were treated in such a way as to render any data within it impossible to recover.

Because the quantities of these unwanted medications and devices may be small, the cost and inconvenience of collecting them for safe disposal often becomes excessive, creating a significant disincentive to such disposal. A device that incinerates a medication or electronic waste to a harmless state and that can be recycled would be an advantage.

SUMMARY

Disclosed herein is a disposable, hand-held or readily portable incinerator for destroying by incineration a quantity of medications, such as leftover, over-the-counter pharmaceuticals, prescription drugs, controlled drugs, and illegal drugs; data-containing electronic waste ("e-waste") such as thumb drives, smart phones, data cards and computer hard drives; or virtually any other substance or item which can be broken down or rendered unusable by heat.

The incinerator comprises a body having an interior, a lid attachable to the body, insulation surrounding the interior of the body, an igniter proximate to the interior of the body, and a composition capable of generating both heat and free oxygen (the "burn agent") to thermally denature the material to be destroyed and to facilitate combustion of combustible materials.

A feature of the disclosure is that its components cooperate to provide convenient destruction of a quantity of medication or e-waste for safe disposal.

Another feature of the disclosure is that combustion of the burn agent creates an atmosphere of very hot, substantially pure oxygen within the burn chamber to facilitate the combustion of any organic materials present.

Another feature of the disclosure is that it includes a filter system with two filtration stages for the off-gases to prevent or reduce air pollution: the first filtration stage employing a noncombustible filtering agent such as silica gel, while the second stage employs a higher-efficiency particulate filter, such as activated charcoal.

Further disclosed is a method for disposing of medication, e-waste or similar unwanted material comprising the steps of opening the lid to present the interior of the incinerator body; placing the unwanted material in the interior of the body; adding a burn agent from an external source, if not already present; re-closing the incinerator; activating the igniter to ignite the burn agent; filtering the hot escaping gases to minimize air pollution; and then, once combustion is complete, disposing of the incinerator or the inner portion thereof holding the spent burn agent and any remains of the unwanted material.

A feature of the disclosure is insulation surrounding the interior of the body to minimize the temperature rise at its exterior surface and to ensure more complete combustion of its contents.

Another feature of the disclosure is that the insulation may be a foamed anhydrite, able to be cast in place as a gypsum foamed by catalytic action and then freed of chemically-bound water by heating. This insulation has the advantages of low material cost, low weight, good heat resistance, lack of any known toxicity or other biological hazard, and convenient recycling.

Another feature of the disclosure is that the insulation is surrounded and mechanically protected by an outer envelope, the insulation and the envelope able to be handled as a unit before, during, and after use, and then discarded or recycled as a unit.

Another feature of the disclosure is that the body, the lid, or both have plural air holes or a continuous air channel, permitting the interior of the body to communicate with the exterior of the body and vent off-gases from combustion.

Another feature of the disclosure is that the off-gases leaving the interior of the body pass through one or more filtration zones before escaping to the outside. Filtration zones may contain activated charcoal, silica gel, porous zeolite materials, molecular sieves or other high-surface-area materials capable of absorbing or adsorbing contaminants. In each of the aspects, the off-gases pass through a first zone containing a noncombustible filter agent such as silica gel, followed by a second zone preferably containing activated charcoal.

Another feature of the disclosure is that the lid may be locked to the body of the incinerator prior to combustion. The body may have locking tabs and the lid, a locking groove for receiving the locking tabs thereby locking the lid to the body during incineration. Alternatively, the lid may have the locking tabs and the body, the locking groove. As another alternative, a lever-operated locking mechanism, similar to that on a conventional ammunition box, may be provided.

Another feature of the disclosure is that the igniter has a first portion interior to the body, in contact with the burn agent, and an external portion that is operable to cause ignition. The external portion may be, for example, a pull-tab having a rest position and a pulled position. When the pull-tab is moved from the rest position to the pulled position, the igniter is activated.

For instance, the pull-tab might have a surface coated in a first chemical mixture and sliding against a surface coated with a second mixture, these mixtures being similar to those used in a safety match. Pulling the tab would cause these mixtures to rub together and ignite. The internal portion of the igniter would then serve as a pyrotechnic delay element yielding a 15- to 20-second delay so the person activating the device could withdraw to a safe distance before burn agent ignition.

Alternatively, the igniter could be electric with a Nichrome or other resistive element contacting either the burn agent or another combustible material, such as a short length of safety fuse (also called "cannon" or "visco" fuse) attached thereto. Completing an electric circuit, desirably via wireless remote control, would then ignite the burn agent.

As another alternative, the igniter could simply be a length of safety fuse extending from the burn agent to the exterior of the device, its length inherently providing the needed safety delay.

A feature of the disclosed method is allowing the incinerator or its non-reusable inner portion to cool before disposing of it.

Those skilled in waste disposal requirements will recognize other features and their advantages from a careful reading of the following Detailed Description, accompanied by the drawings.

BRIEF DESCRIPTION OF THE DRAWINGS

In the figures,

FIG. 7*a* is a perspective, partially cut-away view of the body and closure means of the complete incinerator device according to a third aspect of the disclosure except for the igniter and for removable modules containing the burn agent and filtering materials, while

FIG. 10*a* is a partially cut-away view of a third burn-agent igniter, also usable with the second or third aspects of the disclosure, while

DETAILED DESCRIPTION

Referring now to FIGS. 1 through 12, there is illustrated a hand-held or readily portable incinerator for quantities of medications, e-waste or similar unwanted material.

Figure 1:
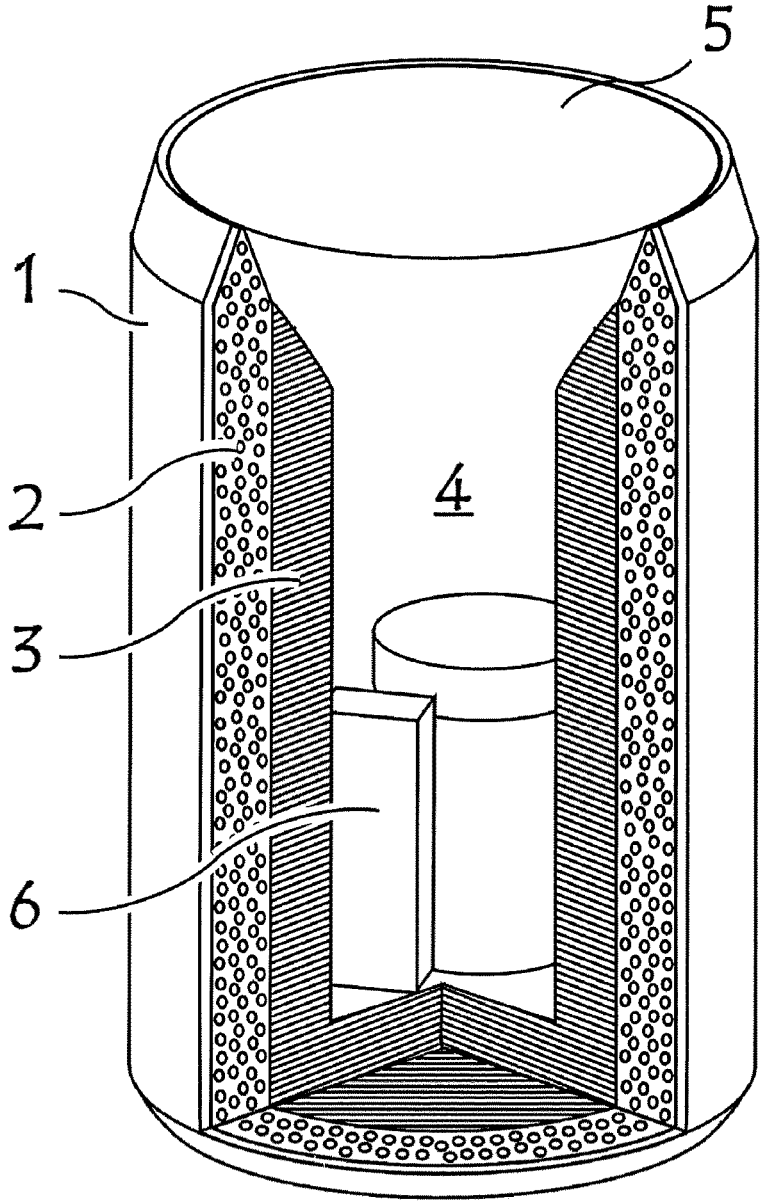
FIG. 1 is a perspective, partially cut-away view of the inner, non-reusable and desirably recyclable portion of an incinerator device, according to a first aspect of the disclosure.

FIG. 1 shows a perspective, partially cut-away view of the inner, non-reusable and desirably recyclable portion of an incinerator device according to a first aspect of the disclosure, optimized for low cost and recyclability, hereafter called the "low cost" version.

Container 1 is preferably made of metal, more preferably of aluminum, and most preferably the size of a standard aluminum beverage can in any of the standard sizes from eight to forty ounces, with the top removed.

Inside container 1 is cast or otherwise installed an insulating layer 2 of low-density, porous and heat-resisting insulation. Insulating layer 2 may be formed from any known insulating material, such as fiberglass or porous firebrick, and is preferably cast in place from a porous gypsum composition thereafter converted to heat-resisting anhydrite, as detailed later in this disclosure and shown in FIG. 3 and the accompanying text.

Within insulating layer 2 is a burn agent 3. Burn agent 3, also formed as a layer, contains solid materials which, upon ignition, will react thereby releasing heat and free oxygen while leaving behind the remaining reaction products as a solid residue, much as do the "oxygen candles" used to provide emergency breathing oxygen on aircraft.

Burn agent 3 may, for example, comprise a powdered metal chlorate, a "smoothing" catalyst to ease the chlorate's decomposition, and a powdered reactive metal as the fuel. See for example William Schlechter, U.S. Pat. No. 2,469,414, "Chlorate candles as oxygen-yielding compositions"; and Yunchang Zhang et al., both U.S. Pat. No. 6,264,896, "Oxygen generating compositions" and U.S. Pat. No. 6,007,736, "Oxygen generating compositions catalyzed by copper and nickel oxides," which are hereby incorporated in their entirety by reference. To simplify safe disposal, the toxicity of the catalyst must be low. Preparation and performance of a suitable burn agents for the present purpose are summarized in EXAMPLE 2 described below in this disclosure.

After formation of insulating layer 2 the burn agent 3, moistened for molding, is formed by gentle compression into a layer leaving a central cavity 4 as shown, then dried. Burn agent 3 must be as nearly free of perchlorates as possible since these are very hygroscopic and, if present, will retard or prevent drying.

Once layers 2 and 3 are dry, container 1 is sealed with a water-impermeable lid 5 to protect layers 2 and 3 mechanically and to prevent re-absorption of water, which could interfere with burn-agent combustion.

In use, lid 5 is removed and burn items 6 to be destroyed, here represented by a thumb drive and prescription medicine bottle shown in simplified outline, are dropped into cavity 4. The incinerator device is then re-assembled and burn agent 3 is ignited, surrounding the burn items with an atmosphere of very hot, substantially pure oxygen that destroys or degrades pharmaceutical substances and renders data on any electronic devices unrecoverable.

Figure 2:
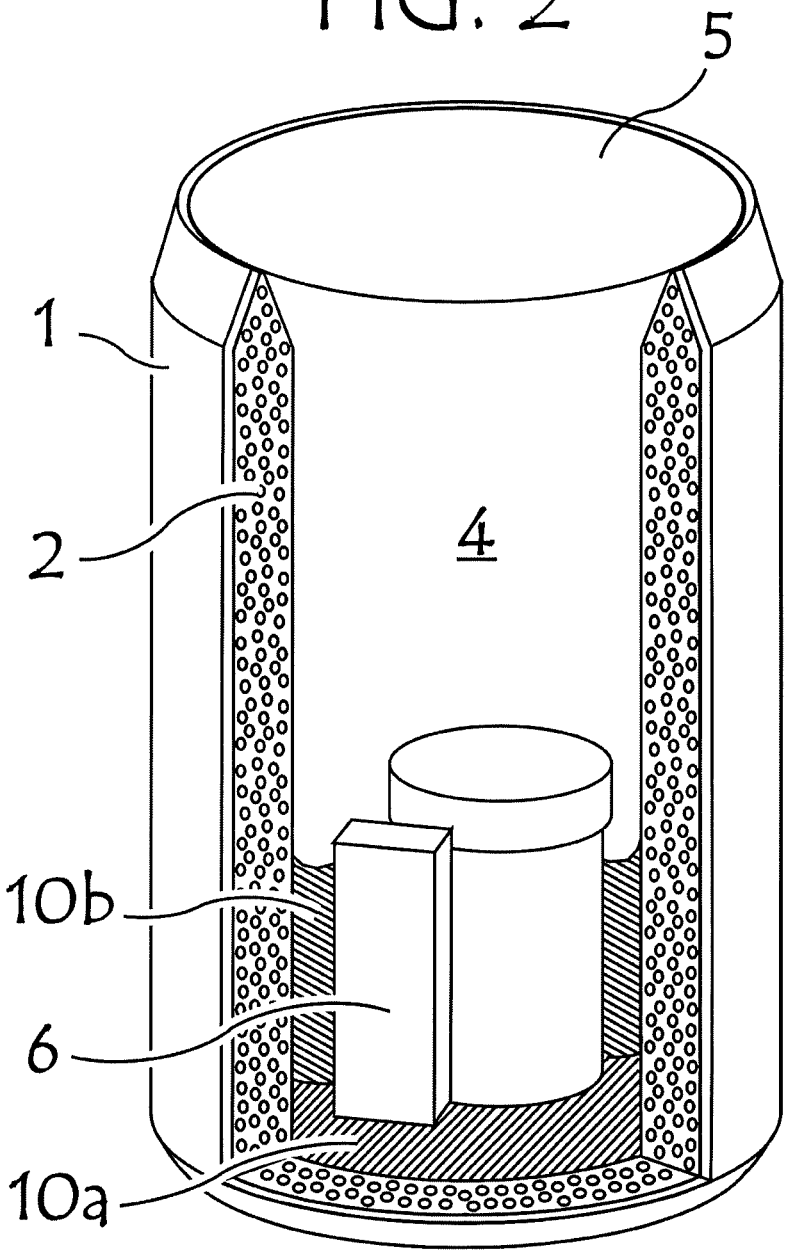
FIG. 2 is a perspective, partially cut-away view of the inner portion of the incinerator device according to the first aspect of the disclosure, and using a different burn agent configuration.

FIG. 2 shows a perspective, partially cut-away view of the inner portion of the incinerator device according to the first aspect of the disclosure using a different configuration for burn agent 3.

Container 1 and insulating layer 2 are as described above in the first aspect of the disclosure. Instead of forming a continuous pre-placed burn agent 3, burn agent 3 is provided in powder form and is poured by the user into central cavity 4 just before use. Burn agent 3 is pre-measured so the user need only open a water-impermeable bag and pour in the agent in. Burn agent 3 may be divided between two such bags, with the contents of a first bag 10*a* poured in, the burn items 6 added, then contents of a second bag 10*b* poured over burn items 6 to partially surround them with burn agent 3, as shown in FIG. 2.

For safety in transportation, and especially to prevent accidental ignition, the bag or bags of burn agent are preferably placed in cavity 4 by the manufacturer and protected by attaching lid 5 prior to use.

After placement of the burn items 6 and burn agent 3, the incinerator device is then assembled, burn agent 3 ignited, and burn items 6 destroyed in the manner previously described.

Figure 3:
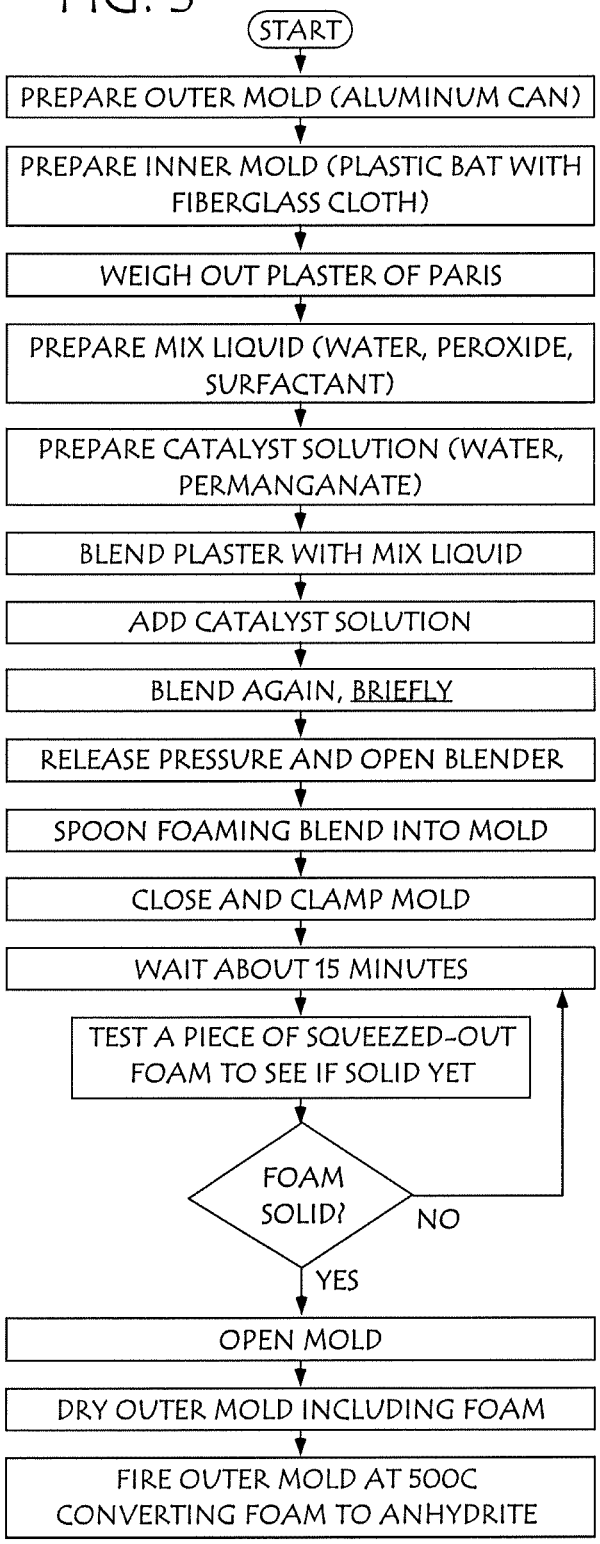
FIG. 3 is a flow chart illustrating the manufacture of a body of a lightweight, low-cost and easily recyclable insulation for use in lining the incinerator device.

FIG. 3 is a flow chart illustrating the manufacture of a body of a lightweight, low-cost and easily recyclable insulation for use in lining the incinerator device. The chart is self-explanatory in light of EXAMPLE 1 given below. Its early steps, apart from the shape and construction of the molds, are those disclosed by Friedrich Hinsche et al. in U.S. Pat. No. 4,072,786, "Production of Floor Toppings by Flowing Inorganic Binder Suspensions Over Porous Open-Cell Underlays," which is hereby incorporated in its entirety by reference. The final step shown below, of converting porous gypsum material to anhydrite to form a heat-resistant thermal insulation, is not taught by Hinshce et al.

As is well known in the art of making plaster of Paris, calcium sulfate dihydrate (Gypsum, $CaSO_4.2H_2O$; MW 172.17) transforms to hemihydrate (Plaster of Paris, $CaSO_4.\frac{1}{2}H_2O$, MW 145.15) at 100-150° C., then to gamma-anhydrite ($CaSO_4$, "soluble" anhydrite, MW 136.14) at 180° C., and then to beta-anhydrite ("insoluble anhydrite," same M.W.) above 250° C. Beta-anhydrite melts and begins to decompose at 1302° C. For comparison, pure aluminum melts at 660.32° C. while type "E" fiberglass, used in making fiberglass cloth, softens at 846° C.

Conversion of one gram of calcium sulfate hemihydrate stoichiometrically back to the dihydrate requires 186 milligrams of water. For workability a larger amount of mix water, typically one-half the volume of the hemihydrate, is usually used.

Example 1

Figure 4:
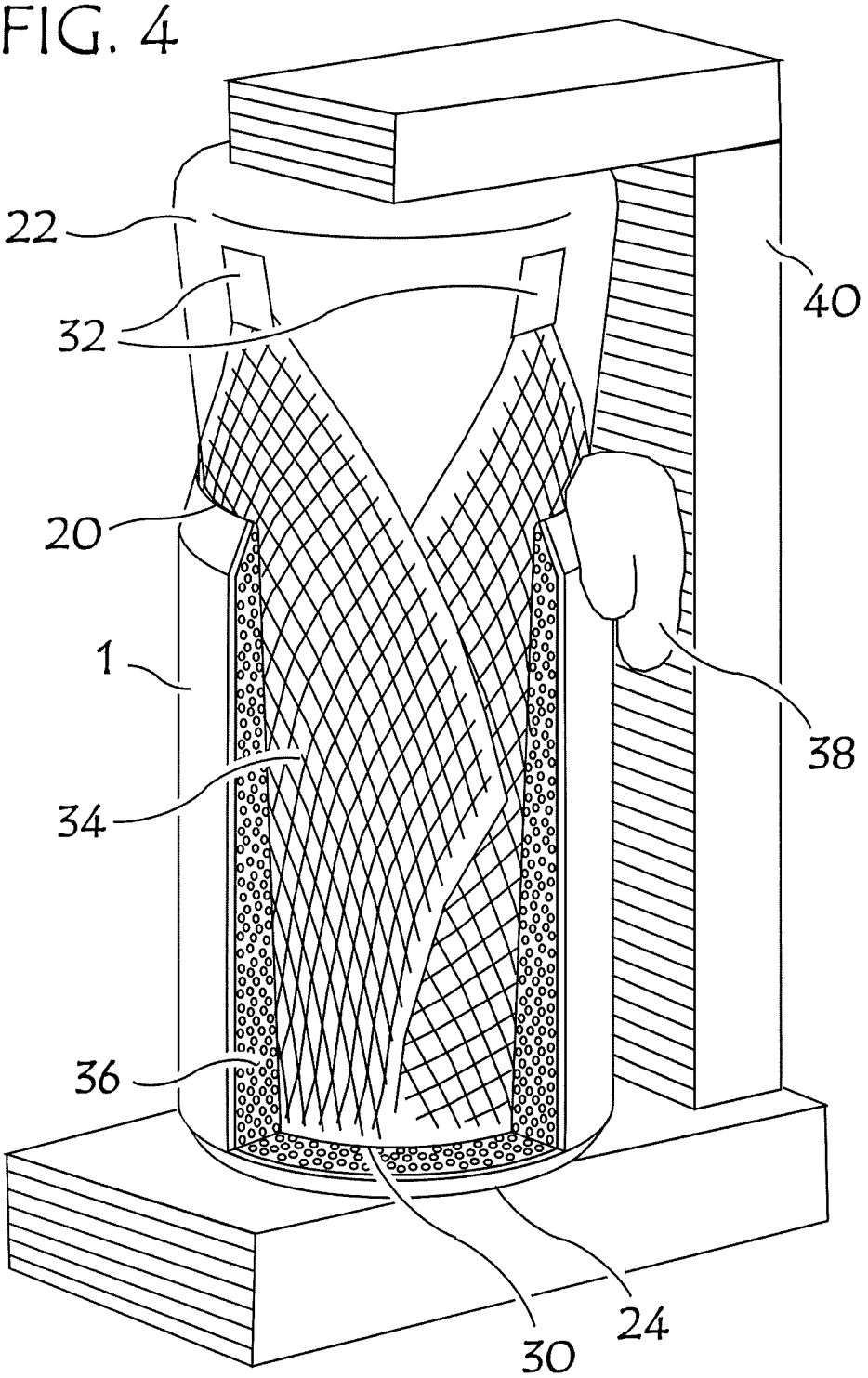
FIG. 4 is a perspective, partially cut-away view of the inner portion of the incinerator device during casting of the insulation.

FIG. 4 shows a perspective, partially cut-away view of the inner portion of the incinerator device during casting of the insulation.

Container 1 shown in FIGS. 1 and 2, was a common 12-ounce (354 milliliter), 66 millimeter O.D. aluminum beverage can 1'. Can 1' was cut off roughly halfway up the region in which it tapered from its maximum diameter to the diameter of the top, leaving a rim 20 open with a diameter slightly less than the maximum diameter of the can 1'.

A tapered inner mold 22 was made of high-density polyethylene. The narrow end of inner mold 22 was inserted into can 1' so that the narrow end just filled the diameter of can 1' at top. A last section was then cut away leaving roughly one-quarter inch of clearance between the slightly domed bottom 24 of can 1' and the plane 30 of cut end of mold 22. The cut end of can 1' was then sealed with two layers of heavy-duty duct tape.

Before inner mold 22 was used, a 9-inch square of 5.4-ounce Type "E" fiberglass cloth was slit 3" inward from the center of each straight side toward the center, creating four 4.5" squares joined by a center hub. This hub was placed over the duct-tape-covered end of the inner mold, and the corners of the square were gently stretched lengthwise on the inner mold and fastened to it with tape 32 forming a fiberglass layer 34 surrounding the inner mold and extending above the rim 20 of container 1.

Plaster of Paris, taken straight from the package, was found to have a density of 0.929 gram per cubic centimeter. 96.0 grams were weighed out and mixed with a dilute solution of hydrogen peroxide plus a surfactant, namely, 20 milliliters of 3% commercial hydrogen peroxide in 30 milliliters of distilled water plus about 380 milligrams of sodium laureth sulfate dissolved in 3.2 milliliters of water. The resulting mix liquid contained about 1.1% hydrogen peroxide plus about 0.7% sodium laureth sulfate, the balance being water.

A stock solution of potassium permanganate ($KMnO_4$) was prepared by placing 500 milligrams of $KMnO_4$ in a 50-milliliter volumetric flask, dissolving it in about 20 milliliters of distilled water, then filling to the 50-milliliter mark to yielding a 1.0% $KMnO_4$ solution.

This solution was then mixed in a cup (not shown). The dry plaster of Paris was placed in the cup, the mix liquid added, and its contents blended for 60 seconds. One milliliter of the stock 1% $KMnO_4$ solution was gently dispensed onto the surface of the wet mix using a syringe.

As quickly as possible the mixture was blended for a further ten seconds, which started the peroxide decomposition releasing oxygen as a foaming agent. Still working quickly, the mix 36, foamy and warm from reaction heat and visibly rising, was spooned into the outer mold, and the inner mold was pushed into place. A small amount of foam 38 oozed out around the edges while additional foam was forced into the pores of fiberglass cloth 34, locking it in place. Progress of setting was monitored by testing excess foam 38. Complete setting took about one hour.

When foam 36 had set, fiberglass layer 34 was untaped from inner mold 22, which was then carefully removed with a twisting motion leaving fiberglass layer 34 behind as a lining for central cavity 4, protecting the inner surface of insulating layer 2, as shown in FIGS. 1 and 2. Excess foam 38 was cleaned away and the excess fiberglass layer 34 cut off flush with can top rim 20.

Container 1, including insulating layer 2 and fiberglass layer 34, was dried overnight at 60° C. to remove unreacted water. Can 1' was then fired for one hour at 500° C. to drive off chemically-bound water, and to convert the foamed gypsum to gamma-anhydrite without melting the aluminum or the fiberglass.

Tests on a piece of the broken-off foam 38 showed that it withstands blowtorch heat, glowing yellow-white without melting or any other apparent change. A yellow-white glow represents roughly 1200° C.

Figure 5A:
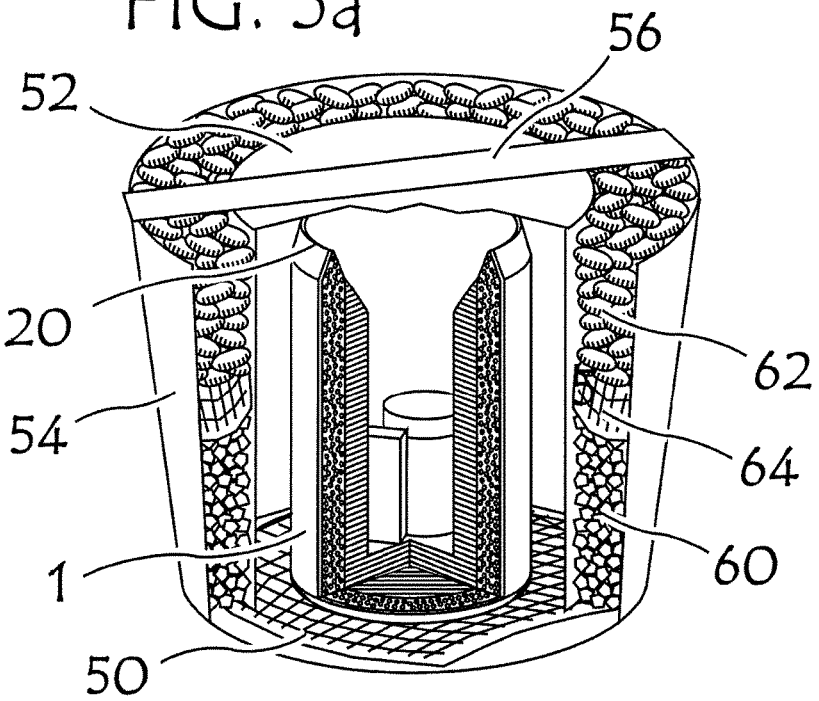
FIG. 5*a* is a perspective, partially cut-away view of the complete incinerator device according to the first aspect of the disclosure, including both its reusable and non-reusable portions except for the igniter.

FIG. 5*a* shows a perspective, partially cut-away view of the complete incinerator device according to the first aspect of the disclosure, the low-cost version, including both its reusable and non-reusable portions, and except for the igniter.

Container 1 and its contents are as shown and described in FIGS. 1 and 2. Placed under container 1 is a pad 50 of porous, heat-resisting material, preferably fiberglass cloth, containing channels through which hot combustion gases may pass.

Surrounding container 1 and its contents is a second container 52, placed with its opening downward and rim resting on pad 50, and covering container 1. The height of container 52 is chosen to provide open clearance between its solid bottom (now turned upward) and rim 20 of container 1, again allowing the passage of hot gases.

Surrounding second container 52 in turn is a third container 54, which may be straight-sided and preferably is a tapered pail as shown in the drawing. Container 1, second container 52 and third container 54 are chosen to have successively wider outside diameters, leaving a clear channel between the outer surface of container 1 and the inner surface of second container 52 and again between the outer surface of second container 52 and the inner surface of third container 54. Both second container 52 and third container 54 are made of heat-resistant material such as steel, and are intended for reuse. For example, if container 1 is a US standard 12-ounce beverage can prepared as previously set forth (2⅝" wide by 4½" tall), second container 52 is conveniently a standard 1-quart steel paint can (4" wide×6" tall), and third container 54 is conveniently a two-quart steel pail (4⅞" wide at bottom, 6" wide at top and 5¼" tall).

The assembly of container 1, second container 52 and third container 54 may be locked together by some mechanical means, for example by a heat-resistant tie-down strap 56 as shown in FIG. 5*a*. This permits some slight upward motion of second container 52, nominally about one-quarter inch, upon ignition of burn agent 3 to allow combustion gases to escape more readily under the rim of second container 52. Alternatively, to keep costs down, the assembly may simply be held together by gravity. In the latter case, second container 52 normally rises an inch or more due to the increased gas pressure upon burn agent ignition. Tests suggest such motion does not significantly impact the device's performance.

Placed in the space between the outer surface of second container 52 and the inner surface of third container 54 are successively a volume of a noncombustible first filtering agent 60 such as dry silica gel, expanded perlite or molecular sieves, and a volume of a second and more efficient, and optionally combustible, second filtering agent 62 such as activated charcoal. Both of these act as filters for combustion gases leaving container 1, removing both particulate matter and some harmful chemical species.

First filtering agent 60 is placed so that the hot gases will pass through it first, serving as a thermal buffer and preventing actual flame from the combustion in container 1 from reaching second filtering agent 62, which may be combustible. A smaller volume of first agent 60 is needed than of second agent 62. For example, in tests of this aspect of the disclosure, 40 grams of silica gel were followed in each case by 150 grams of charcoal.

Filtering agents 60 and 62 are preferably separated by a loosely-packed ring of fiberglass cloth 64 to aid in gas distribution and in separation of the two filter materials, if desired, for reuse after combustion. Alternatively, second agent 62 may be enclosed in a ring-shaped fiberglass cloth bag simply laid on top of the layer of gel, or both agents may be enclosed in such bags.

Like can 52 and pail 54, filtering agents 60 and 62 are intended for reuse and depending on the nature of the burn items, can probably be used about ten times before requiring disposal.

Figure 5B:
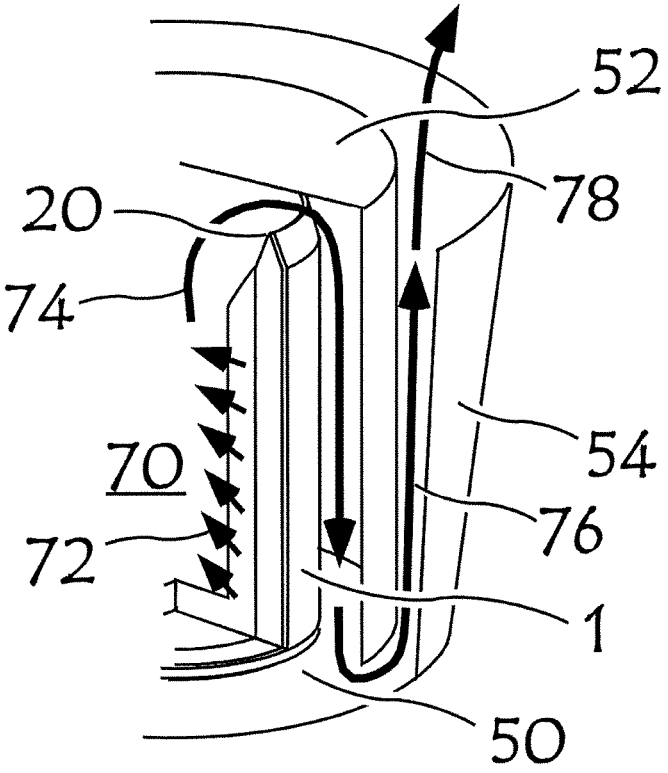
FIG. 5*b* is a simplified version of FIG. 5*a* with arrows showing the paths taken by combustion gases.

FIG. 5*b* is a simplified version of FIG. 5*a*, with arrows showing the paths taken by combustion gases. Since the device is cylindrically symmetrical, one-half of it is shown in the FIG. 5*b*.

Hot oxygen released from the ignited burn agent passes into the central combustion area 70 as indicated by arrows 72. The heat breaks down organic materials in combustion area 70, including plastics and pharmaceutical materials, which then combust in the oxygen. A mixture of oxygen, gaseous decomposition products released from the burn items, and combustion products passes over rim 20 of container 1 and downward through the space between container 1 and can 52 as indicated by arrow 74, then returns upward through first filtering agent 60 and second filtering agent 62 (not shown in FIG. 5*b*) between second container 52 and third container 54 as indicated by arrow 76. By then, the expanding gases have reacted and cooled enough for filtration to be effective.

The mixture of gases, holding some unreacted oxygen and combustible decomposition products, then exits upward from third container 54 as indicated by arrow 78. The hot gases typically then burst into flame again, this flame having the transparent appearance of one containing enough, or nearly enough, oxygen for complete and final combustion of the decomposition products.

Figure 6:
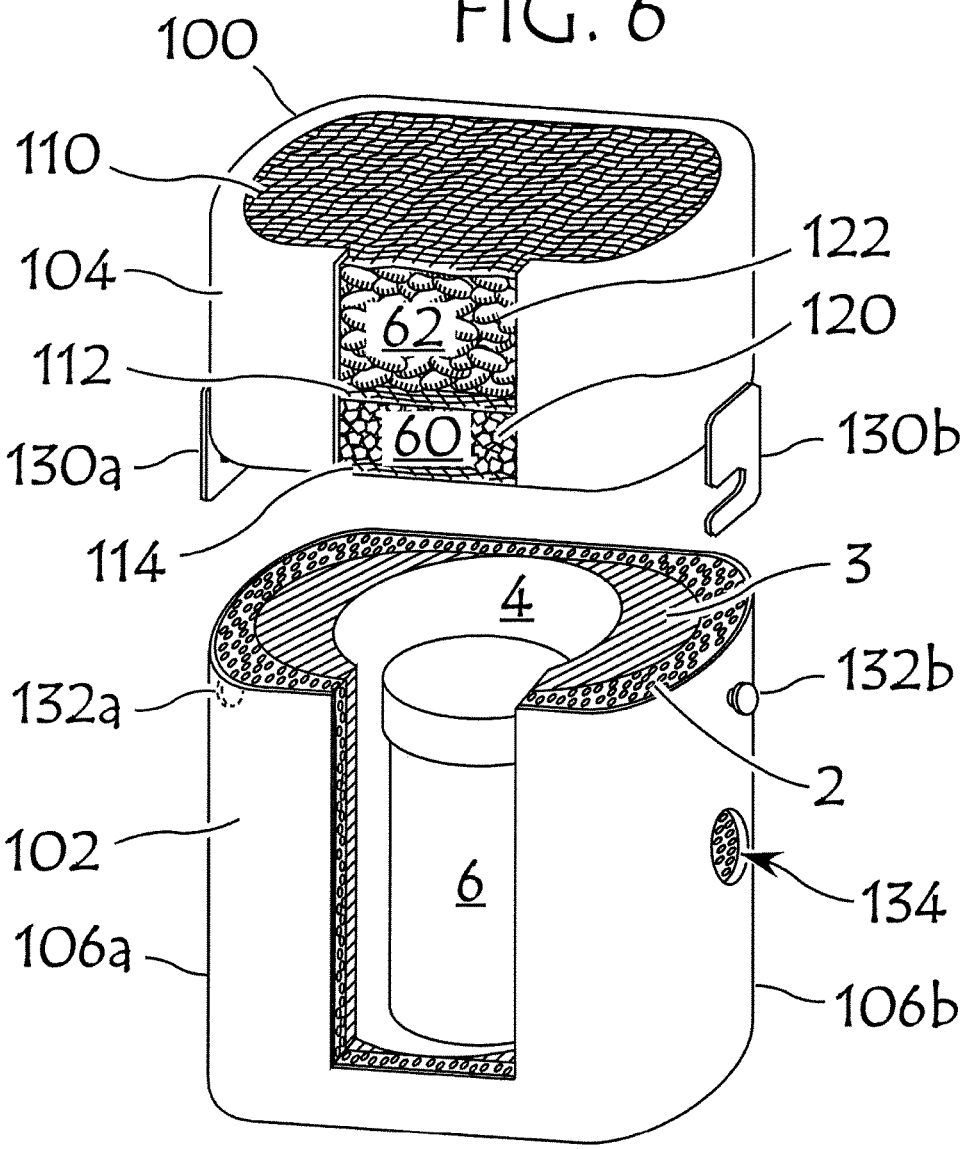
FIG. 6 is a perspective, partially cut-away view of the complete incinerator device according to a second aspect of the disclosure except for the igniter.

FIG. 6 shows a perspective, partially cut-away view of the complete incinerator 100 according to a second aspect of the disclosure, except for the igniter. Optimized for compactness, incinerator 100 will hereafter be referred to as the "pocket" version. It is intended for one-time use, and thus has no reusable portions.

Incinerator 100 is made of heat-resistant material, preferably in the form of a flattened and partly squared-off cylinder measuring about one and one-half by three by six inches and generally indicated by 100, which is divided into two parts, a burn housing 102 and a filter housing 104.

Burn housing 102 is lined, except at its open top, with thermally insulating material 2 as previously disclosed. Insulating material 2 is thicker near the narrow ends 106 and 106*b*, thinner toward the adjacent wider sides, leaving more space for burn item or items 6 (here represented by a prescription vial) in center cavity 4. Burn agent 3 is placed near narrow ends 106*a* and 106*b* by the same method explained in the text accompanying FIG. 2, again thinning toward the wider sides or absent there to leave more space for the burn items.

Filter housing 104 is divided by porous partitions 110, 112 and 114 of heat-resistant material, such as fiberglass, into compartments 120 and 122. Compartment 120, which in use is set adjacent to burn housing 102, holds first, (noncombustible) filtering agent 60, while compartment 122 holds second (more efficient) filtering agent 62, as previously disclosed. Hot gases from combustion pass successively through partition 114, compartment 120 with filtering agent 60, partition 112, compartment 122 with filtering agent 62, and partition 110 before exiting to the open air.

Burn housing 102 and filter housing 104 are removably or openably fastened together by means such as a hinge and latch or a pair of latches of any conventional type. To forestall the opening of incinerator 100 during combustion, the fastening means must be made of heat-resistant material. As one example, a simple bayonet-style twist-lock mechanism, similar to that in a BNC electrical connector, comprising two slotted metal lugs 130*a* and 130*b* and two fixed metal studs 132*a* and 132*b* (the former not visible in FIG. 6), may be used to secure burn housing 102 to filter housing 104.

A hole 134 passing through the wall of burn housing 102 and insulation 2 exposing burn agent 3 at its bottom, permits the igniter (not shown in FIG. 6), normally kept separate from burn housing 102 and its contents for safety, to be attached temporarily conveying heat through the hole to ignite burn agent 3. Hole 134 is preferably kept covered by tape or plugged by a stopper until use.

To use incinerator 100 the burn item(s) are placed in cavity 4, the two housings are placed together with a slight angular offset, then twisted into alignment causing metal lugs 130*a* and 130*b* to engage studs 132*a* and 132*b* locking the housings together. The burn agent is then ignited.

Figure 7A:
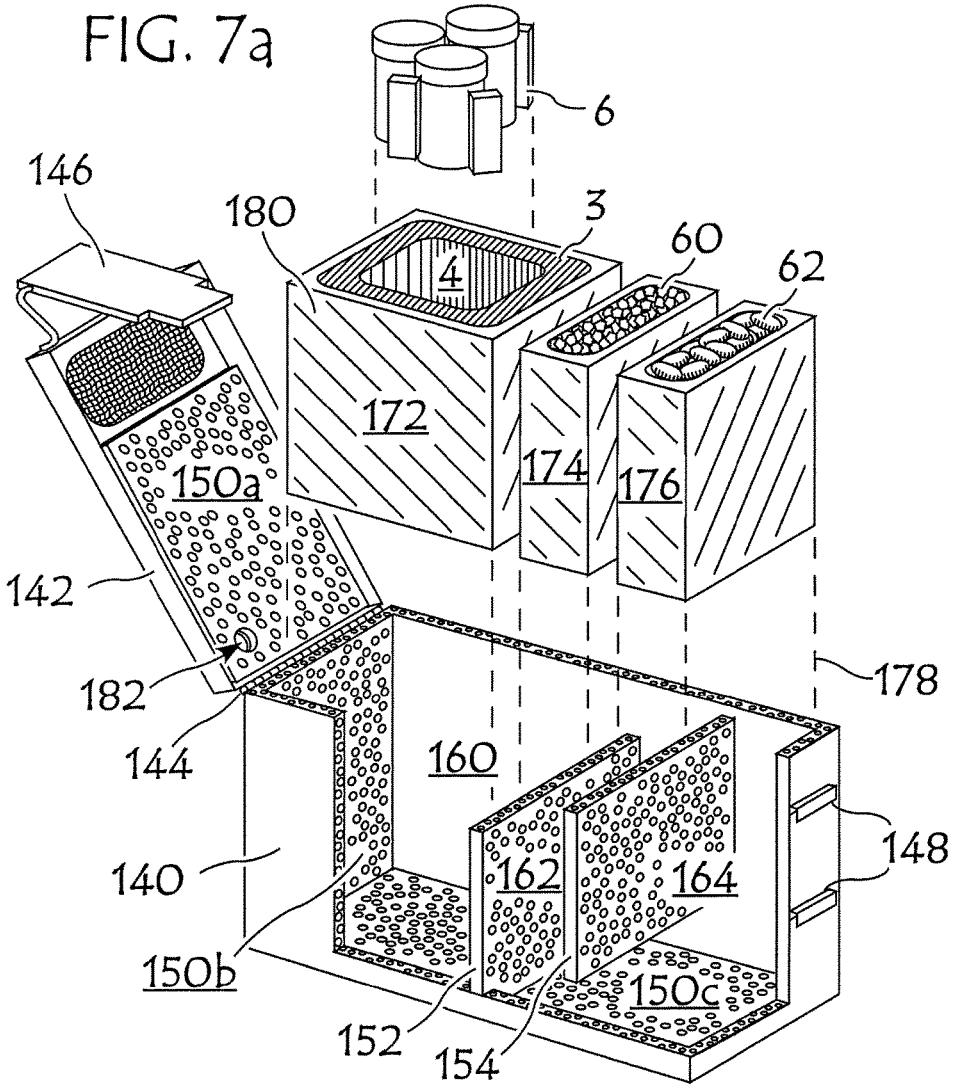

FIG. 7*a* is a perspective, partially cut-away view of the body and closure means of incinerator 100 according to a third aspect of the disclosure, except for the igniter, to be described presently, and removable modules containing burn agent 3, first filtering agent 60 and second filtering agent 62.

A reusable housing 140 is made of a heat-resistant material, preferably heavy-gauge steel, taking the general form of a rectangular solid with one face openable or removable. For example, housing 140 may be a steel ammunition box as shown, with lid 142 being the openable face. Such boxes are available in a variety of sizes suitable for the present device. For simplicity in the following discussion, it will be assumed that such a box is used. Of course housing 140 could equally well take any of numerous other configurations.

For use, lid 142 must be held firmly against the rest of the housing to prevent unfiltered combustion gases from escaping. In a standard steel ammunition box this is accomplished through hinge 144 and latching lever 146 engaging ledge or ledges 148 on the stationary part of the box.

Housing 140, including most of lid 142, is lined with panels of heat-resistant and thermally insulating material such as 150*a*, 150*b* and 150*c*. These panels are preferably rigid, removable, and replaceable as needed. More preferably, they may be made from a nontoxic material such as calcium silicate. An example of a suitable material is Grainger #19NE44, ½ inch-thick calcium silicate insulating board. The stock number represents a 24"×48" piece from which several lining panels could be cut. Alternatively, panels could be made from fiberglass cloth dipped in conventionally mixed (non-foaming) plaster of Paris, allowed to harden in suitable molds, and then fired, thereby converting the resulting gypsum to anhydrite as previously discussed.

Two interior baffles, namely, first baffle 152 and second baffle 154, are placed inside housing 140, dividing it roughly into three chambers 160, 162 and 164 respectively holding burn agent 3 and burn items 6, first filtering agent 60, and second filtering agent 62 when the device is used. First baffle 152 and second baffle 154 are rigid, heat-resistant and thermally insulating, may be of the same material as the lining panels, and may, for example, slide into shallow slots pre-formed in these panels to receive them. First baffle 152 is placed so as to leave a gap at the top, thereby forcing combustion gases from chamber 160 to flow over its top. Second baffle 154 is positioned to leave a similar gap at the bottom so gases leaving chamber 162 must flow under it into chamber 164. A heat-resistant mesh or grating 170 (best seen in FIG. 7*b*) is set in lid 142, above chamber 164 and a gap left in the insulation of lid 142, to permit gas exit.

Figure 7B:
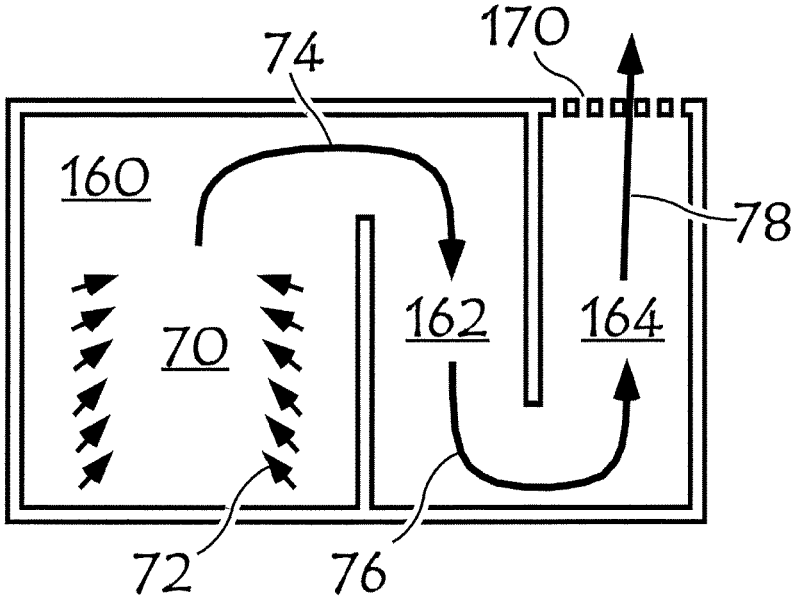
FIG. 7*b* is a simplified cross-section of the same device shown in FIG. 7*a* with arrows showing the paths taken by combustion gases.

FIG. 7*b* shows the resulting gas flow. For easy comparison with FIG. 5*b*, the same reference characters are used when appropriate.

Hot oxygen released from the ignited burn agent passes into the central combustion area 70 within chamber 160 as indicated by arrows 72. The heat breaks down organic materials in the combustion zone, including plastics and pharmaceutical materials, which then combust in the oxygen. A mixture of oxygen, gaseous decomposition products released from the burn items, and combustion products passes over the upper edge of first baffle 152, then downward through chamber 162 and first filtering agent 60 as indicated by arrow 74. Passing next below the bottom edge of second baffle 154 the gases rise again through chamber 164 and second filtering agent 62, as indicated by arrow 76, before exiting the device through mesh or grating 170, as indicated by arrow 78.

For user convenience, burn agent 3, first filtering agent 60, and second filtering agent 62 are preferably pre-packaged in blocks or modules: burn module 172, first filter module 174 and second filter module 176, respectively. Burn agent module 172 has central cavity 4 pre-formed in it to receive burn items 6. For clarity, these modules are shown above, rather than inside, housing 140, with dashed lines such as 178 indicating they are to be inserted before use. Spent modules, 172, 174, 176, are removed and replaced as needed. Burn agent module 172 is removed and replaced after every use. The other components are replaced as they become saturated with combustion products or degraded by heat.

To prevent undesired absorption of materials from the environment before use, all modules are wrapped in a film 180 (FIG. 7*a*). Film 180 may be relatively impermeable to water vapor and other gases, and as thin as possible since film 180 itself will use a portion of the oxygen released from the burn agent 3. The same type of metallized polycarbonate (e.g., Mylar®) film commonly used to package snack foods is suitable.

A hole 182 passing through lid 142 and insulating panel 150*a* permits the igniter (not shown), normally kept separate from housing 140 and its contents for safety, to be attached temporarily in order to convey heat through hole 182 to ignite burn agent 3.

Figure 8:
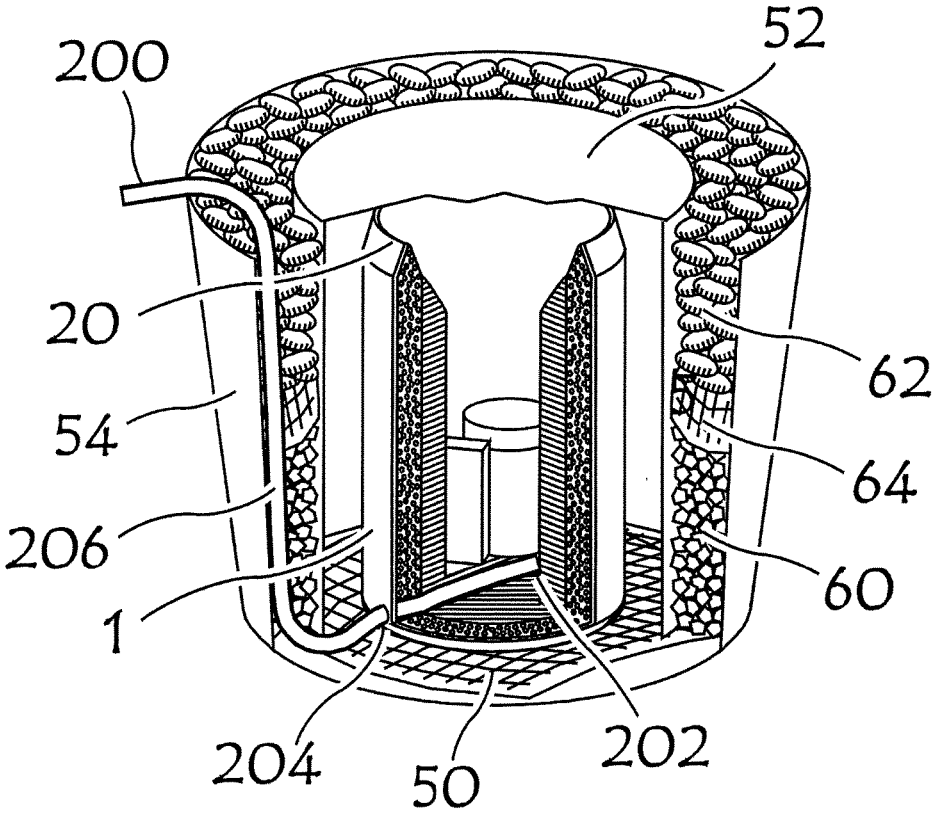
FIG. 8 is a perspective, partially cut-away view of the complete incinerator device according to the first aspect of the disclosure, showing a first burn-agent igniter.

FIG. 8 shows a perspective, partially cut-away view of the complete incinerator 100 according to the first aspect of the disclosure, showing a burn-agent igniter 200. For simplicity and ease of comparison, FIG. 8 replicates FIG. 5*a* and adds several identifying reference numbers.

Igniter 200 may simply be a length of safety fuse 206 (also commonly called "cannon" or "visco" fuse) with a controlled burn rate of about one-half inch per second. Fuse 206 is widely available in bulk from fireworks suppliers. Container 1 is preferably supplied with fuse 206 already in place, one end of fuse 206 entering the can through a hole pierced through the metal wall and the insulation inside it, just above the top level of the insulation covering the can floor.

Fuse 206 preferably has its inner end 202 anchored to insulation 2 near or against the wall opposite its point of entry. If burn agent 3 is pre-formed into a solid block, the connection with fuse 206 may be done simply by forming burn agent with fuse 206 already in place. For further stability, fuse 206 is preferably also anchored to container 1 at the point 204 where it passes through its wall. A small amount of flexible cement, such as "Eclectic Goop," has been found suitable for this purpose.

Before use, length 206 of fuse 206 outside the can is conveniently coiled around the can itself and its end secured, for example, with a piece of tape. Prior to use, fuse 206 is uncoiled and, as the device is assembled, guided under the rim of upturned can 52, fiberglass 50 acting as padding; up through the space between can 52 and pail 54, passing through filter media 60 and 62; and thus to the outside. Using the specific can and pail previously identified, the total length for fuse 206 is ten inches with roughly the last inch in contact with the burn agent.

Fuse 206 is then lighted in any conventional manner, for example with a match. At a burn rate of one-half inch per second this provides a delay of about eighteen seconds, allowing the person lighting it to withdraw to a safe distance before burn agent 3 ignites.

Figure 9:
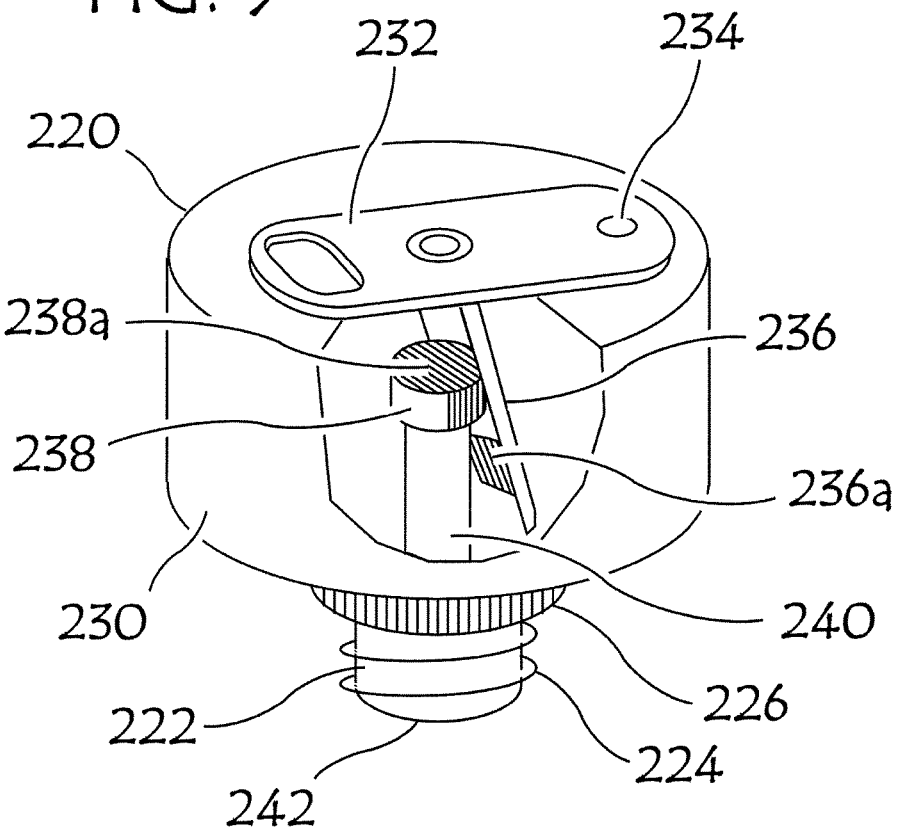
FIG. 9 is a closeup, partially cut-away view of a second burn-agent igniter, usable with the second or third aspects of the disclosure.

FIG. 9 is a closeup, partially cut-away view of a second igniter 200, usable with the second or third aspects of the disclosure described above.

An ignition module generally indicated by 220, intended for one-time use, has an extension 222 designed to pass through and tightly engage hole 134 in the second aspect of the disclosure or hole 182 in the third aspect of the disclosure. For example, the exterior of extension 222 may be equipped with coarse self-tapping threads 224. A soft, heat-resistant gasket 226, made, for example, of silicone rubber, prevents hot gases from escaping around the lip of extension 222 during combustion.

For safety, ignition module 220 is kept separate from the remainder of the device until the device is otherwise fully loaded and ready to use. Module 220 is then connected and activated. After a delay allowing the user to retreat to safety, heat or fire is produced at the end of extension 222 igniting the burn agent to destroy the burn items.

Ignition module 220 comprises an outer housing 230, a pull-tab 232 pivoting on a stationary rivet 234 affixed to outer housing 230, a movable striking surface 236, a stationary ignitable surface 238, and a slow-burning fuse 240 extending through extension 222 to its end.

Pull-tab 232 is constructed similar to the pull-tab on a soft-drink can, and is held immobile during normal handling. On application of force, the tab "pops" free causing movable striking surface 236 to rub across stationary ignitable surface 238.

Movable striking surface 236 has a coating 236*a* with one-half of an incendiary formula, while stationary striking surface 238 has a coating 238*a* with the other half of the incendiary formula so that upon friction, the mixture on it bursts into flame in the manner of a match head.

For example, coating 236*a* may comprise red phosphorus, ground glass, a binder and a neutralizer while coating 238*a* comprises potassium chlorate, antimony sulfide, a binder and a neutralizer. Other usable combinations are well-known in the art of making safety matches and "strike-anywhere" matches.

Desirably, movable striking surface 236 is partly or completely folded around stationary striking surface 238 to increase the contact area. Stationary striking surface 238 may then have coating 238*a* on both sides, or the mixture may form a cylinder or bulb surrounding it, much like a conventional match head.

For added safety, the geometry of movable striking surface 236 and stationary striking surface 238 is preferably such that until pull-tab 232 is pulled, a space remains between coating 236*a* and coating 238*a* preventing accidental ignition by impact, vibration or rough handling.

Ignition of coatings 236*a* and 238*a* starts in turn the combustion of slow-burning fuse 240, requiring about fifteen to twenty seconds to burn to its opposite end and thus comprising a pyrotechnic delay permitting the user to retire to a safe distance prior to burn agent ignition. For example, slow burning fuse 240 may comprise chiefly potassium chlorate plus an aromatic reductant as is disclosed in Andre Espagnacq, U.S. Pat. No. 6,723,191, "Slow combustion pyrotechnic composition," which is hereby incorporated by reference. This composition, enclosed in a suitable metallic tube, is said to burn at a rate of about one millimeter per second thus providing the needed delay in a length of about three-quarters of an inch. Other delay compositions and configurations, well-known in the art of pyrotechnics, could also be used.

Slow-burning fuse 240 extends through the length of extension 222, and at its further end 242 when fully inserted into the main body of the device is pressed against the surface of burn agent 3. After burning through its length, the fire initiated by the pulling of pull-tab 232 thus ignites the burn agent. An amount of a faster-burning composition, which for manufacturing convenience may be the same as coating 238*a*, may be set in further end 242 providing a burst of flame to ensure ignition in case a slight gap remains between the end of slow burning fuse 240 and the burn agent.

Figure 10A:
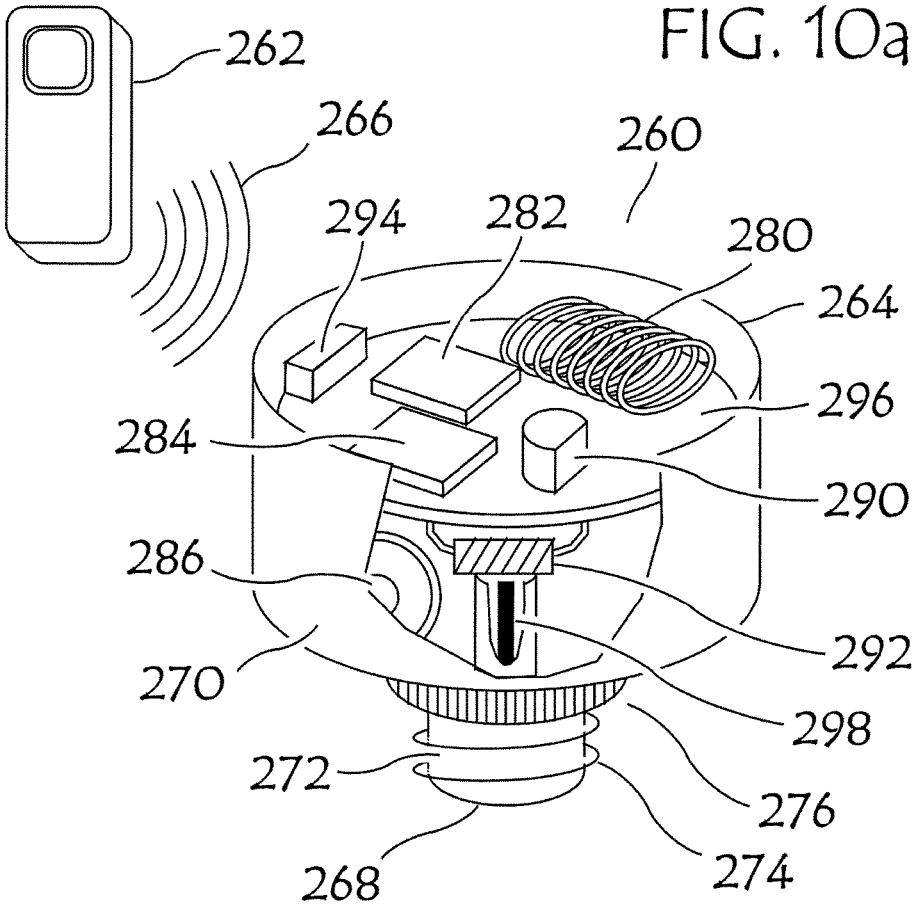
Figure 10B:
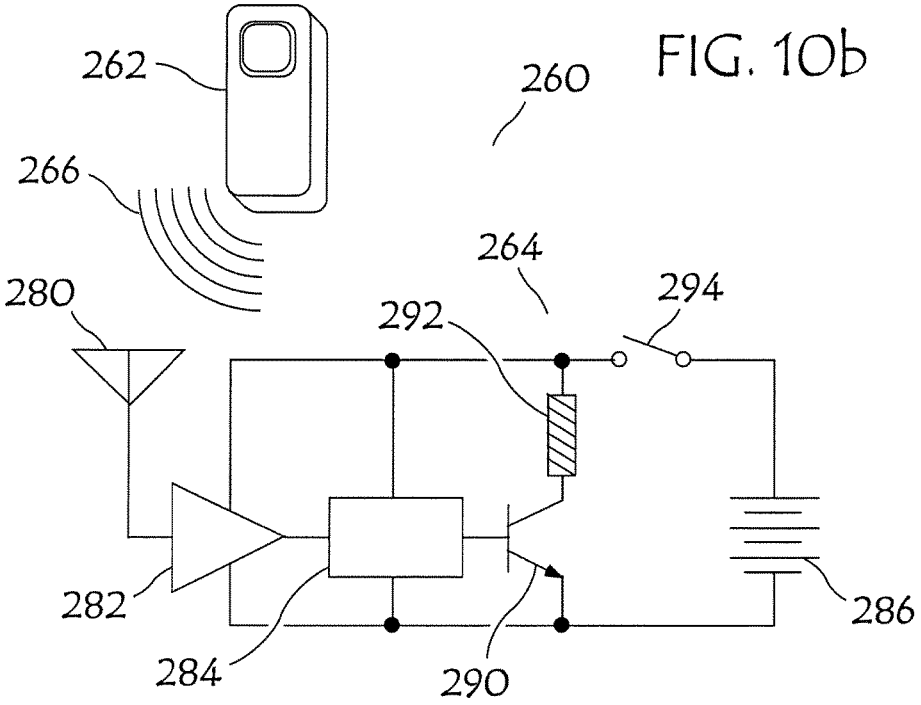
FIG. 10*b* shows the same device in simplified electronic schematic form.

FIG. 10*a* shows a partially cut-away view of a third burn-agent igniter, also usable with the second or third aspect of the disclosure, while FIG. 10*b* shows the same device in simplified electronic schematic form.

Igniter, generally indicated by 260, comprises a remote transmitter 262 and a receiver 264 able to be connected to the incinerator device and there to ignite burn agent 3 upon receiving a command from transmitter 262. The principle of radio remote control is well-known and widely used in commercial products. Common examples are remote doorbells and automobile remote keyless entry systems. A similar product, the wireless remote fireworks firing system available from Ziyan Fireworks in China, may be adaptable for use in this invention.

Transmitter 262 generates a short-range radio signal 266 which, to prevent accidental operation of receiver 264 (whether it is connected to the incinerator device or not), is desirably encrypted. Rotating codes may be used for further security. To minimize cost, a fixed code may be used.

Receiver 264 is held in a housing 270 generally similar to that of the previously-described ignition module 220, and like it, has an extension 272 designed to pass through and tightly engage hole 134, in the second aspect of the disclosure, or engage hole 182, in the third aspect of the disclosure, so its tip 268 is present against burn agent 3 when ready for use. For example, the exterior of extension 272 may be equipped with coarse self-tapping threads 274. A soft, heat-resistant gasket 276, made for example of silicone rubber, prevents hot gases from escaping around extension 272 during combustion.

Inside housing 270 are a coiled-wire or antenna 280, an amplifier-demodulator 282, a decoding circuit 284, a battery 286 (which may be made up, for example, of four AA or AAA cells), a relay or transistor 290 (here shown as an NPN transistor), and a heat-producing resistive element 292 located in or near extension 272. While not strictly necessary, an arming switch 294 is also desirable both for added safety and so that amplifier-demodulator 282 and decoding circuit 284 do not run continuously and drain the battery. Amplifier-demodulator 282, decoding circuit 284, transistor or relay 290 and arming switch 294 are preferably mounted on a circuit board 296, with arming switch 294 accessible from the outside through an opening in housing 270 (not visible in FIG. 10*a*), while battery 286 is mounted below.

Whenever receiver 264 is switched on, incoming radio signals received through antenna 280 are amplified and analyzed by amplifier-demodulator 282 and decoding circuit 284, respectively. Upon receiving a correctly-coded signal from transmitter 262 the decoding circuit closes or turns on relay or transistor 290, allowing a relatively strong current to flow from battery 286 to resistive element 292 thus generating a temperature high enough to ignite a pyrotechnic composition.

If desired, resistive element 292 may be located at tip 268 of extension 272 and contact and ignite burn agent 3 directly. Alternatively, a degree of protection for the resistive element, and likely better reliability as well, may be achieved by setting resistive element 292 back slightly within the hollow center of extension 272, and extending from circuit board 296 for easy connection to the other electronics components, and inserting a short, pre-cut length of safety fuse 298 into the space between it and the tip as shown in FIG. 10*b*. Resistive element 292 is thus partly isolated from the burn agent and its decomposition products, which will include sodium chloride known to be corrosive to some electric resistance materials. Instead, resistive element 292 ignites safety fuse 298 which, after roughly one second of delay, creates a burst of flame at the surface of burn agent 3 causing it to ignite.

Figure 11:
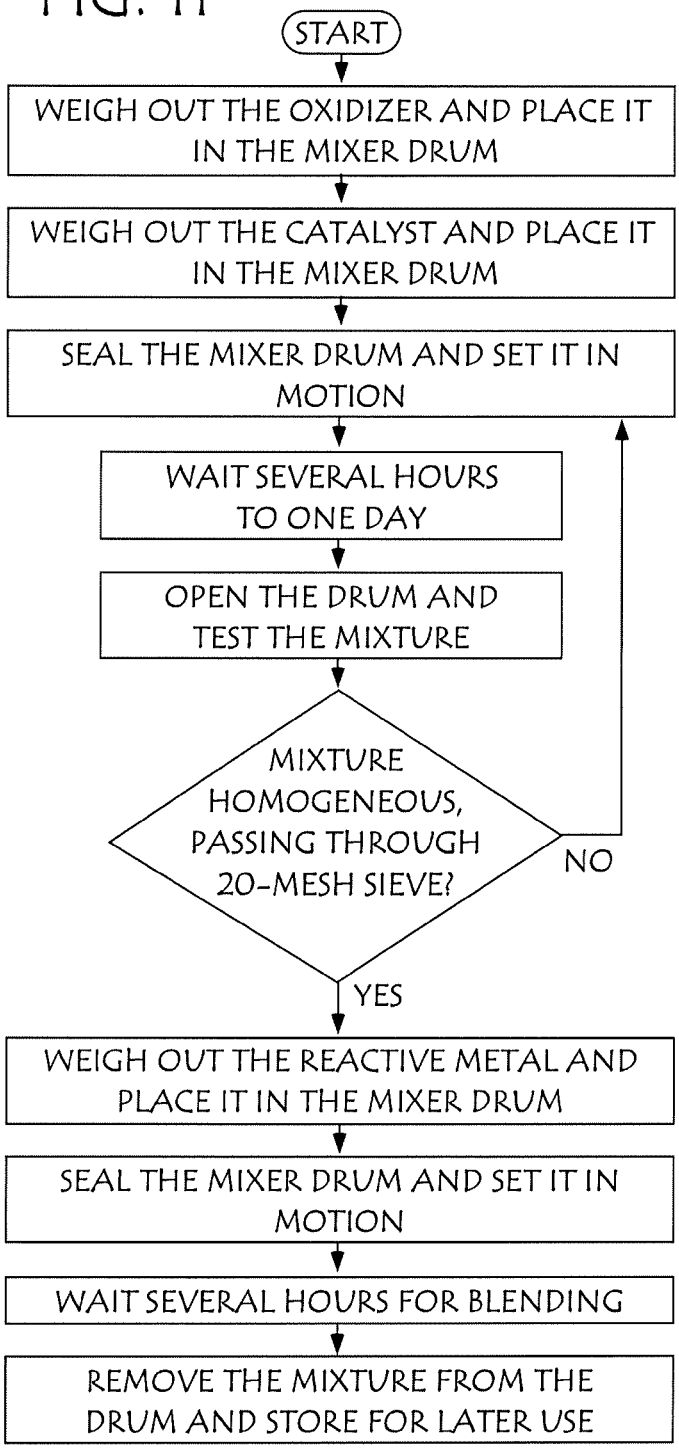
FIG. 11 is a flow chart illustrating the manufacture of a burn agent for use in the incinerator device; and, FIG. 12 is an Arrhenius plot of data retention time in solid-state drives, which use the same data-storage principle as flash drives, as it varies with temperature.

FIG. 11 is a flow chart illustrating the manufacture of a burn agent for use in the incinerator device. Only the major steps are shown. The chart is meant to be self-explanatory in light of EXAMPLE 2 given below.

The burn agent is comprised of a solid oxidizing agent, a smoothing catalyst to ease the oxidizer's decomposition, a reactive metal as the fuel, and optionally a diluent to help reduce or control the burn rate.

The oxidizer may be chosen from the group consisting of ammonium, alkali metal or alkali earth metal nitrates, chlorates, perchlorates, percarbonates, peroxides, perborates and persulfates (preferably anhydrous), or it may be a mixture of two or more such materials. More preferably it is an alkali metal chlorate, and most preferably it is pure sodium chlorate. For effective blending with the other burn agent components, the oxidizer must be ground to a fine powder.

The smoothing catalyst functions to ease the oxidizer's decomposition when heated, providing a smooth release of oxygen and not the sudden explosion which could result from thermal runaway. In a conventional oxygen candle, the catalyst is usually barium peroxide. Since all known compounds of barium are toxic except its highly insoluble sulfate, and since the intent of the present disclosure is recyclability with minimal impact on the environment, barium peroxide is deemed unusable in the present device.

The catalyst may therefore be chosen from the group of all oxygen-bearing compounds of transition metals and alkali earth metals of low inherent toxicity, or it may be a mixture of two or more such compounds. Preferably the metal, or at least one metal if a plurality are present, can exist in more than one oxidation state, and does exist in a higher one of such states. More preferably, the compound is also physically soft so it may easily be ground to a fine powder. An example of such a compound is potassium permanganate.

The oxidizer and catalyst may be mixed intimately by grinding them together to a fine powder, for instance in a ball mill. Since some oxidizers, especially the chlorates and perchlorates, are friction-sensitive, care must be taken to exclude all organic and other easily-oxidized materials from the grinding process. Sulfur and chlorates, for example, are likely to burst into flame when ground together: a phenomenon well-known in the art of pyrotechnics.

The reactive metal may be any solid metallic element of low toxicity whose reaction with oxygen releases energy and whose oxide is also a solid at ordinary temperatures, or it may be a mixture or alloy of two or more such elements. Preferably, the metal is easily converted to a powdered form by processes such as filing, grinding or melting followed by atomization and cooling. More preferably the resulting powdered metal is stable in dry or moist air at ordinary temperatures, either unreactive or forming a thin resistant surface film preventing further reaction.

As reactive metals, aluminum, magnesium, zirconium, iron, zinc, manganese and titanium, along with their alloys, are all suitable for use in the device. Pure iron, reduced to powder by atomization, seems to have the best balance of properties overall as witnessed by its long history of use in oxygen candles.

With certain combinations of metal, oxidizer and catalyst, it may be desirable to introduce some other, unreactive or nearly unreactive substance as a diluent to reduce or help control the reaction rate. Such materials are powdered glass, glass microspheres or microballoons, fly ash, and powdered or fumed silica. In an aspect of the present disclosure, using a mixture of powdered iron, sodium chlorate and potassium permanganate as catalyst, a diluent was found unnecessary.

The burn agent and process for preparing it were developed through a series of experimental "burns," first in open crucibles and later in aluminum cans insulated with foamed anhydrite as described above, in a series of experiments. EXAMPLE 2 proved to be the most satisfactory burn agent. EXAMPLE 3 records the performance of this same agent in destroying representative burn items in one of the insulated cans.

The weights shown in square brackets in EXAMPLE 2 are calculated targets; those following outside the brackets are the actual weights used. All weights are in grams. The resulting burn agent contains about 62.5% sodium chlorate, 0.625% potassium permanganate, and 36.9% powdered iron.

Example 2

Sodium chlorate, industrial grade (>99%), coarsely granular: [125.0 g] 125.012 g.

Potassium permanganate, industrial grade (>99%), granular "free pouring": [1.250 g] 1.246 g.

Iron powder, "Atomet 67" (>99%; with particle size 100-200 mesh): [73.775 g] 73.765 g.

The sodium chlorate, potassium permanganate, and iron powder were added, in that order, to the rubber drum of a Lortone #3a, three-pound-capacity rock tumbler also containing about 200 grams of ½" flattened glass beads, thus acting as a simple ball mill. No liquid was added.

The tumbler was placed well away from structures which could be damaged or materials which could be set on fire by accidental ignition. The tumbler was then started remotely by plugging in the far end of an extension cord. No ignition occurred.

The tumbler contents were checked periodically, at several-hour intervals through the first day and daily thereafter. Each time the mixture was checked for homogeneity and especially for remaining visible chlorate grains, some of which took a long time to disappear. Milling was deemed complete when the mixture passed easily through a 20-mesh sieve. With the equipment used, this phase took about five days.

The mixture in the drum by then appeared to be homogeneous, uniformly light brown, and powdery. It was stored in a sealed jar pending use.

Since the powdered iron was already atomized, the procedure above could be made safer by waiting to add the iron until the chlorate and permanganate had been milled and blended. This would avoid having a fuel present during most of the milling, and especially when the largest chlorate grains were being broken up and the greatest potential for ignition might be expected. FIG. 11 reflects this change.

It may be noted that while this particular mixing method was time-intensive, requiring days for thorough conversion of the drum contents to powder, other methods such as crushing the chlorate and permanganate grains between rotating cylinders or vibrating angled plates before mixing with the iron powder could achieve similar results in a matter of minutes.

Example 3

One of the insulated cans previously described was modified by having a type "K" thermocouple, held in a stainless-steel probe, inserted horizontally through the can wall with its tip roughly centered inside the can. A three-inch length of cannon fuse was inserted halfway through a second hole just above the top of the insulation and fiberglass layer at the bottom of the can, and secured with a small amount of "Eclectic Goop." To the exposed end of the fuse was attached a twelve-volt electric igniter of a type commercially sold by fireworks suppliers.

The can was set outdoors on concrete blocks, and the thermocouple was connected to a Delta DTB-48 temperature controller set in shade a few feet away. The igniter was attached to a length of two-wire speaker cable, run to an elevated deck about fifty feet away, having a clear view of the can, so the burn agent could be remotely ignited and the results video recorded for later analysis.

Burn items were an unopened one-ounce plastic box of candy mints, simulating unwanted medications in a plastic prescription vial; a ferrite ring magnet, simulating magnetized iron-oxide recording material holding data in a computer disk drive; and an actual thumb drive. To avoid loss and further simulate operating conditions the magnet was placed on a piece of sheet steel, itself cut from a scrap electronic chassis, and held there by its own attraction.

The mixture was tested by first placing 25 grams of burn agent in the bottom of the can and covering the fuse, placing the burn items on top of it, then pouring a second 25 grams of burn agent over the top, as was shown in FIG. 2. A "tent" formed from one square foot of 3.6-ounce fiberglass cloth was then fastened over the can mouth, simulating an early (and ultimately discarded) design for the filter.

The weather being hot and the can exposed to full sunlight, the starting temperature measured by the thermocouple was 41° C.

The electric igniter was triggered by touching the far ends of the speaker wire to a battery. The burn agent ignited four seconds later. A cloud of smoke appeared, followed by visible flame within the fiberglass "tent." Six seconds after ignition the flame burned through the fiberglass and rose higher. Burn agent combustion lasted a total of about 21 seconds.

Once visible flame appeared, the amount of visible smoke being emitted sharply decreased, suggesting this smoke comprised material destructively distilled from the burn items that are not quite consumed by the generated oxygen. The nearly transparent nature of the flame showed little carbon or other solid material generated in combustion, nearly all the combustion products thus exiting the flame zone in gaseous form and presumably as nearly pure water and carbon dioxide.

As soon as it was certain the burn agent combustion was over, the thermocouple temperature was read as 678° C. Because the temperature reading was rapidly declining when read and several seconds had elapsed since the burn's end the peak temperature was likely much higher, around 750° C.

Of the burn items, the following observations were made:

Candy mints box and its contents were unrecognizable, and had become a foamy black charred mass. Any medications exposed to like conditions, therefore, would surely have been rendered as mostly carbon.

The aluminum housing of the thumb drive was melted, the metal surface very uneven and in part missing, and through the gaps it was evident that all organic material inside it had been destroyed. Only a web of bare fiberglass remained where the circuit board had been.

The ceramic magnet was found shattered by the heat, but its fragments were easily collected with another magnet. Bringing them into proximity with unmagnetized steel showed no attraction remained. In other words, the material had not only been physically broken but its stored magnetism had also been wiped away.

All burn items were therefore deemed to have been successfully destroyed.

Regarding the destruction of data-holding devices, as opposed to their mere erasure, it may be noted that aluminum melts around 660° C., while the melting points of even the highest-fusing solders used on electronic circuit boards fall below 300° C. Manufacturers of integrated circuits do not normally approve storage, let alone operation, above 150° C. These facts, together with the circuit board's reduction to bare fiberglass, show that even were the silicon data-storage chip itself undamaged, after even brief exposure to melting-aluminum temperatures the electronics supporting it would have been rendered nonfunctional.

Magnetic materials, meaning those capable of holding permanent magnetic fields and thereby storing data, are each characterized by a "Curie temperature" above which the material changes to a different, nonmagnetic crystal or electronic form. On cooling, the material may once again become magnetic, but all traces of its former magnetic field have disappeared.

A modern hard disk drive uses a cobalt-chromium-platinum alloy, deposited in a very thin film on an aluminum platter (the "disk"). Although it is possible that higher Curie temperatures for such alloys have been achieved and are held as trade or Government secrets, the highest Curie temperature openly published is 400° C. for the alloy of 64% cobalt, 14% platinum and 22% chromium. Hence, even if the interior of a drive does not reach aluminum's melting point, achievement of this much more modest temperature will suffice for erasing any information it held.

There remains the slight possibility that an adversary with sufficient resources might be able to recover the silicon data-storage chip from a thumb drive or other solid-state memory device destroyed by the present invention, and restore enough of its external connections to access data that might remain.

Information is stored on a solid-state drive as patterns of electric charge trapped on "floating gates" isolated from the remainder of the circuitry by thin layers of silicon dioxide. Essentially, a floating gate is a tiny capacitor doubling as the control device for a miniaturized transistor. Trapping negative charge on the gate turns off the transistor, representing a binary "0," while trapping positive charge turns it on, representing a "1." A thumb drive may contain several billion of these capacitor-transistor combinations, each holding one bit of information.

The same principle is used in the solid-state drives (SSD's) which are becoming increasingly common as main drives in portable computers, including smart phones, since solid-state memory has no moving parts and this is less subject to wear or mechanical damage than a hard disk drive with spinning platters.

At higher temperatures, reliable data retention time on a solid-state drive rapidly decreases. JEDEC Standards JES47 and JEP122 specify a physics-based acceleration model for charge detrapping, yielding retention times for a lightly used ("client," as opposed to "enterprise") SSD dropping sharply with temperature from 404 weeks at 25° C. power-off temperature (i.e., with the drive not in use) to only eight weeks at 55° C. For more information see "JEDEC SSD Specifications Explained," Alvin Cox, Seagate, a PowerPoint presentation available on-line as of October 2017, which is hereby incorporated by reference.

Arrhenius plots are widely used to evaluate the dependences of physical phenomena on temperature. Specifically, an Arrhenius plot shows the logarithm of the dependent variable (log(k) or ln(k)) as a function of the reciprocal Kelvin temperature (1/T(K), or more commonly 1000/T (K)). For ease of interpretation, the corresponding Celsius (Centigrade) temperatures are often shown along the top of the plot.

If the phenomenon indeed proceeds by a thermally-activated mechanism, the resulting plot will be a straight line whose slope corresponds to an activation energy provided by the heat. Charge detrapping is generally agreed to follow this rule.

Figure 12:
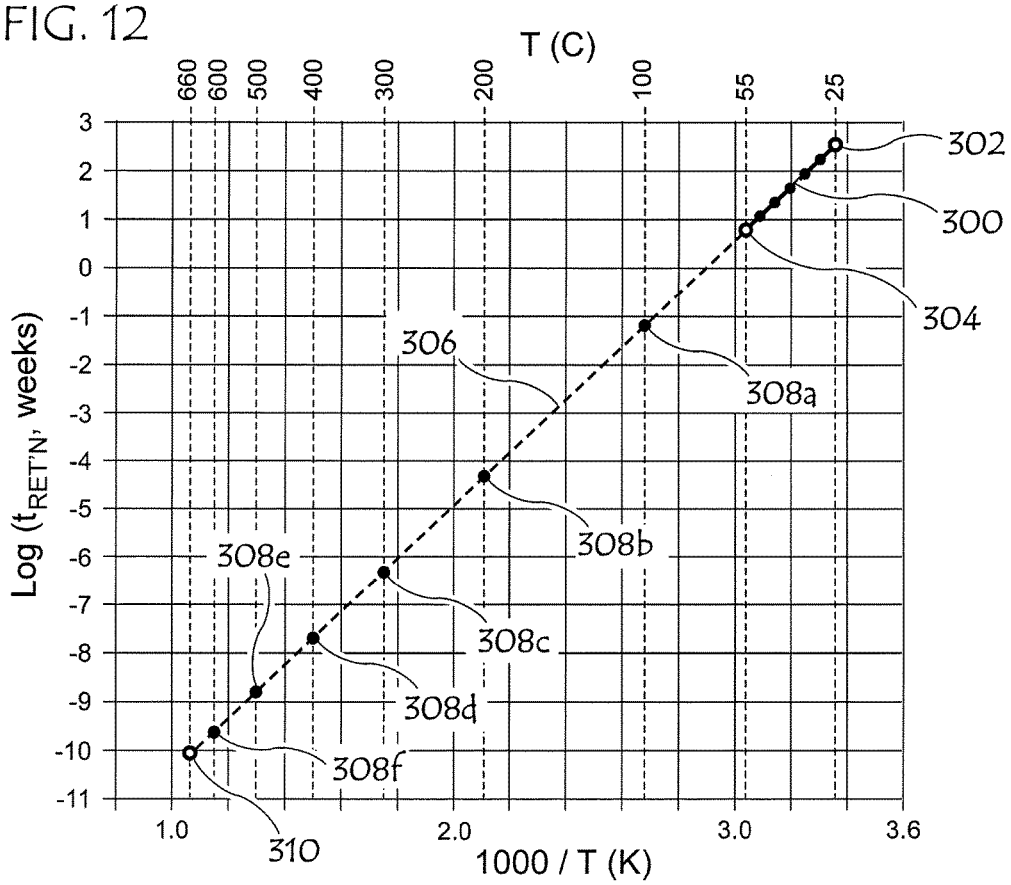

FIG. 12 shows an Arrhenius plot 300 of the relevant data from a table on slide 27 of the Cox presentation, where the dependent variable is taken as the retention time in weeks. These figures indeed yield a straight line from a first endpoint 302 at 25° C. to a second endpoint 304 at 55° C., marked by open circles. (For simplicity, the data points corresponding to intermediate table data are shown by smaller solid dots and not individually labeled.)

While the validity of extrapolating such a plot cannot be taken for granted, since additional processes may well appear or become significant as temperatures rise, such extrapolation can predict at least a phenomenon's general behavior. Plot 300 has therefore been extended up through 660° C., the melting point of aluminum, using dashed straight line 306. Solid dots 308*a* through 308*f* mark the passage of straight line 306 through temperatures of 100° C., 200° C. and so forth up to 600° C., while open circle 310 marks its high-temperature endpoint at 660° C.

Back-solving to find the reliable data retention time at 660° yields $8\times10^{-11}$ weeks, or 48 microseconds.

These time estimates are for "reliable data retention," and not "complete data destruction." In engineering, it is common practice to allow generous safety factors. At room temperature, for instance, charge de-trapping is slow enough that thumb drive data may remain readable for many decades and not the limited 7.7 years (404 weeks) given in the JEDEC specification. Additionally, this is the expected time before the first few bits in an SSD made with current technology become unreadable. Technological advances will likely bring greater reliability and longer retention times. For complete data destruction, despite technological advances a large number of bits would need to be lost to prevent any possible reconstruction of the original data.

Even if the JEDEC estimate is low by an unlikely factor of 100,000, requiring five whole seconds at 660° C. for complete data destruction, the present disclosure will suffice for the task since high temperatures last roughly as long as the burn agent combustion, which with the composition of EXAMPLE 2 and in the geometry tested in EXAMPLE 3 is about twenty seconds.

These calculations and test results verify that data-storage devices using presently popular technologies, including thumb drives and both magnetic and solid-state computer main drives, through incineration using the disclosed incinerator will reliably be rendered unusable and their formerly contained data impossible to recover.

What is claimed is:

1. A device, comprising:

a body having an interior and an exterior, said interior defining a burn chamber dimensioned for holding material to be destroyed, wherein said body has a channel running from said burn chamber to said exterior of said body;

a lid attachable to said body; thermally insulating material in said body;

a burn agent within said insulating layer in said burn chamber;

an igniter operable to ignite said burn agent; and a filter system in said channel.

2. The device of claim 1, wherein said thermally insulating material is foamed anhydrite.

3. The device of claim 1, wherein said thermally insulating material is supported by an outer envelope.

4. The device of claim 1, wherein said filter system comprise a non-combustible filter and a particulate filter.

5. The device of claim 1, wherein said filter system includes silica gel.

6. The device of claim 1, wherein said filter system includes activated charcoal.

7. The device of claim 1, wherein said burn agent releases oxygen when burned.

8. The device of claim 1, wherein said burn agent includes metal chlorate and powered metal.

9. The device of claim 1, wherein said igniter includes an electric starter and a pull-tab operably connected to said electric starter.

10. A device, comprising:

a body having an interior and an exterior, said interior defining a burn chamber dimensioned for holding material to be destroyed, wherein said body has a channel running from said burn chamber to said exterior of said body;

a lid attachable to said body; a thermally insulating material in said body;

a burn agent within said thermally insulating material in said burn chamber, said burn agent releasing oxygen when burned;

an igniter operable to ignite said burn agent; and a filter system in said channel, said filter system including a non-combustible filter.

11. The device of claim 10, wherein said filter system includes a particulate filter.

12. The device of claim 10, wherein said burn agent includes metal chlorate and powdered metal.

13. The device of claim 10, wherein said burn agent includes an alkali metal chlorate, powdered metal, and a non-reactive ingredient.

14. The device of claim 10, wherein said burn agent includes iron powder, potassium permanganate, and sodium chlorate.

15. The device of claim 10, wherein said thermally insulating material is an anhydrite on a fiberglass lining.

16. The device of claim 10, wherein said thermally insulating material is a gamma anhydrite cast on a type E fiberglass lining.

17. The device of claim 10, wherein said filter system further comprises activated charcoal and a ring of cloth between said activated charcoal and said non-combustible filter.

18. The device of claim 10, wherein said non-combustible filter is silica gel and wherein said filter system further comprises activated charcoal.

19. The device of claim 10 wherein said igniter is selected from the group consisting of a friction igniter, a fuse igniter, and an electric igniter.

20. The device of claim 10, wherein said lid is operable to lock to said body.

* * * * *